US005912523A

United States Patent [19]

Ziegler et al.

[11] Patent Number: 5,912,523

[45] Date of Patent: Jun. 15, 1999

[54] CARBON COMMUTATOR

[75] Inventors: William Eugene Ziegler, Reading, Mass.; William A. Bauer, St. Mary's, Pa.

[73] Assignee: McCord Winn Textron Inc., Manchester, N.H.

[21] Appl. No.: 08/937,307

[22] Filed: Oct. 3, 1997

[51] Int. Cl.[6] ..... H01R 39/06; H01R 43/06

[52] U.S. Cl. ..... 310/237; 29/597

[58] Field of Search ..... 310/237, 44, 43, 310/233, 234, 235, 236; 29/597

[56] References Cited

U.S. PATENT DOCUMENTS

| | | | |
|---|---|---|---|
| 3,538,365 | 11/1970 | Reisnecker . | |
| 3,861,027 | 1/1975 | Allen . | |
| 3,983,431 | 9/1976 | Hancock | 310/233 |
| 4,358,319 | 11/1982 | Yoshida et al. . | |
| 5,157,299 | 10/1992 | Gerlach . | |
| 5,175,463 | 12/1992 | Farago et al. . | |
| 5,255,426 | 10/1993 | Farago et al. | 29/597 |
| 5,386,167 | 1/1995 | Strobl . | |
| 5,442,849 | 8/1995 | Strobl . | |
| 5,530,311 | 6/1996 | Ziegler . | |
| 5,552,652 | 9/1996 | Shimoyama et al. | 310/237 |
| 5,677,588 | 10/1997 | Strobi | 310/237 |

FOREIGN PATENT DOCUMENTS

| | | |
|---|---|---|
| 0 021 891 | 1/1981 | European Pat. Off. . |
| 2 633 781 | 7/1989 | France . |
| 89 07 045 | 12/1989 | Germany . |
| 89 07 077 | 12/1989 | Germany . |
| 400 944 | 2/1974 | U.S.S.R. . |

OTHER PUBLICATIONS

Sears et al., University Physics, Sixth Edition, Addison–Wesley Series in Physics, pp. 539–540, 1984.

*Primary Examiner*—Nestor Ramirez
*Assistant Examiner*—Dang Dinh Le
*Attorney, Agent, or Firm*—Reising, Ethington, Barnes, Kisselle, Learman & McCulloch, P.C.

[57] ABSTRACT

A carbon-segment face commutator assembly for an electric motor includes an annular array of copper conductor sections stamped from a single copper blank. The annular array is overmolded with an electrical-conducting resin-bonded carbon composition which mechanically interlocks the conductor sections and defines a circular commutating surface. During overmolding, radial grooves are formed in a bottom surface of the carbon overmold opposite the commutating surface. An annular hub is then formed by overmolding an insulator material around and under the carbon overmold and the conductor section array. The hub insulator material flows into the radial grooves of the carbon overmold and leaves only the circular commutating surface exposed. The carbon overmold is formed into an annular array of eight electrically-isolated carbon segments by machining radial slots inward from the commutating surface of the carbon overmold to the underlying radial grooves. The slots are cut slightly into the insulator material occupying the radial grooves to ensure that the carbon overmold is completely cut through and the carbon segments are electrically isolated from each other.

19 Claims, 4 Drawing Sheets

CARBON COMMUTATOR

TECHNICAL FIELD

This invention relates generally to a carbon-segment commutator for an electric motor and a method for its manufacture.

BACKGROUND OF THE INVENTION

Permanent magnet direct current motors are sometimes used for submerged fuel pump applications. These motors typically employ either face-type commutators or cylinder or "barrel"-type commutators. Face-type commutators have planar, circular commutating surfaces disposed in a plane perpendicular to the axis of armature rotation. Barrel-type commutators have arcuate, cylindrical commutating surfaces disposed on the outer surface of a cylinder that is positioned coaxially around the axis of armature rotation. Regardless of their commutating surface configurations, electric motors used in submerged fuel pump applications must be small and compact, have a long life, be able to operate in a corrosive environment, be economical to manufacture and operate and be essentially maintenance-free.

Submerged fuel pump motors must sometimes operate in a fluid fuel medium containing an oxygen compound, such as methyl alcohol and ethyl alcohol. The alcohol increases the conductivity of the fuel and, therefore, the efficiency of an electrochemical reaction that deplates any copper motor components that are exposed to the fuel. For this reason, carbon and carbon compositions are sometimes used to form carbon segments with segmented commutating surfaces for the motors. This is because carbon commutators do not corrode or "deplate", as copper commutators do. Commutators with carbon segments also typically include metallic contact sections that are in electrical contact with the carbon segments and provide a terminal for physically connecting each electrical contact to an armature coil wire.

It is known to form a carbon commutator by first molding and heat treating a moldable carbon compound or machining heat-treated carbon or carbon/graphite stock. Such an arrangement is shown in German Disclosure 3150505.8. A commutator-insulating hub may then be formed to support the metallic substrate. The hub may be molded directly to the metallic substrate either before or after the carbon is bonded to the metallic substrate. Slots are then machined through the carbon article and the metallic substrate to separate the carbon article and substrate into a number of electrically isolated segments. An inner diameter, outer diameter and the commutating surface of the commutator may also need to be machined.

After the completed commutator is assembled to an armature, a clamshell mold may be positioned over the newly assembled commutator-armature in a final overmolding process. An open end of the clam shell mold is made to seal around the commutator in a manner that leaves the commutating surface exposed. Insulator material is then injected into the clam shell mold. Once the insulator material has cured, the clam shell mold is removed. This final overmolding step protects copper armature windings and other corrosion-prone elements from chemically reacting with ambient fluids such as oxygenated fuels. The overmolding also secures wires to reduce potential for stress failures and to maintain a corrected dynamic balance level. Overmolding will also reduce windage losses in the pump.

Where, in manufacturing such a commutator, cuts are machined into or through a metallic substrate, metal chips may be produced. These metal chips can lodge in the slots between segments causing electrical failures. Machining into a metallic substrate can also expose the cut portions of the substrate to the corrosive effects of oxygenated fuels.

Where the carbon and metal substrate portions of a commutator are machined-through to form electrically isolated segments, some type of support structure must be provided to strengthen the commutator and mechanically bind the carbon segments and conductor sections together. Such support structures sometimes require substantial additional axial space for the commutator, which can increase the overall axial length of the armature-commutator assembly and or reduce the size and the quantity of wire wound in the armature.

For some types of electrical-conducting resin-bonded carbon compositions, an insulating surface skin characteristically forms on exterior surfaces of the composition as it cures. This skin forms an impediment to electrical contact between the carbon composition and the metallic conductor sections. Therefore, a carbon commutator using such a composition must provide an electrical path through the insulating surface skin.

One approach to solving these problems is disclosed in U.S. Pat. No. 5,386,167 issued Jan. 31, 1995 to Strobi (the Strobi patent). The Strobi patent shows a carbon disk made up of an electrical-conducting resin-bonded carbon composition. To avoid problems associated with machining into metal substrates, the carbon disk is overmolded onto eight pie-piece-shaped copper segments then radially cut between the segments to form eight electrically isolated carbon segments. A plastic substrate holds the copper segments in position for carbon overmolding and provides mechanical interlock between the carbon segments. However, the plastic substrate increases the axial thickness of the commutator. In addition, the Strobi patent does not provide structures that would provide an electrical path through carbon composition skinning or structures that might otherwise reduce electrical resistance.

What is needed is a carbon-segment commutator that is stronger and provides lower electrical resistance through increased carbon to copper contact within the carbon segments and through any insulating surface skin that might form. What is also needed is a method for manufacturing such a commutator that requires less machining time and provides longer tool life.

SUMMARY OF THE INVENTION

In accordance with this invention a carbon-segment commutator assembly is provided in which a carbon disk is molded over a pre-stamped metallic substrate having an upturned projection, and an insulator hub is molded over the carbon-overmolded substrate prior to cutting radial slots. The commutator assembly comprises an annular array of at least two circumferentially-spaced conductor sections arranged around a rotational axis and an annular array of at least two circumferentially-spaced carbon segments formed of a conductive carbon composition. Each carbon segment is molded onto at least one surface of a corresponding one of the conductor sections with the annular array defining a segmented commutating surface of the commutator. An overmolded insulator hub is disposed around and between the carbon segments. The insulator hub mechanically interlocks the carbon segments. Each conductor section has at least one conductor projection that is at least partially embedded in a corresponding one of the overmolded carbon segments.

According to one aspect of the present invention a method is provided for making the carbon-segment commutator assembly described above. The method includes forming the annular array of conductor sections then forming a carbon overmold by molding an electrical-conducting resin-bonded carbon composition onto the annular conductor section array. During carbon molding, inner grooves are formed in an inside surface of the carbon overmold opposite the commutating surface. Next, the insulator hub is formed by overmolding the carbon overmold and conductor section array with insulator material that at least partially occupies the inner grooves and mechanically interlocks the carbon segments. Finally, machining slots inward from the commutating surface of the carbon overmold to the inner grooves forms the annular array of electrically isolated carbon segments.

Unlike prior art commutators, the filled inner grooves of the present invention leave only a thin section of the carbon segment to be machined through to electrically isolate the carbon segments. This provides at least three benefits: shallow slots result in a stronger and/or an axially shorter commutator, less machining time is required to cut the slots, and tool wear is reduced resulting in extended tool life.

In addition, the conductor projections of the present invention reduce electrical resistance by increasing surface area contact between the conductor sections and their corresponding carbon segments. The projections also provide lower electrical resistance through increased carbon to copper contact within the carbon segments and provide an electrical path through any insulating surface skin that might form over carbon segments made of certain carbon compositions.

BRIEF DESCRIPTION OF THE DRAWINGS

To better understand and appreciate the invention, refer to the following detailed description in connection with the accompanying drawings.

DETAILED DESCRIPTION OF THE PREFERRED EMBODIMENT

Figure 1:
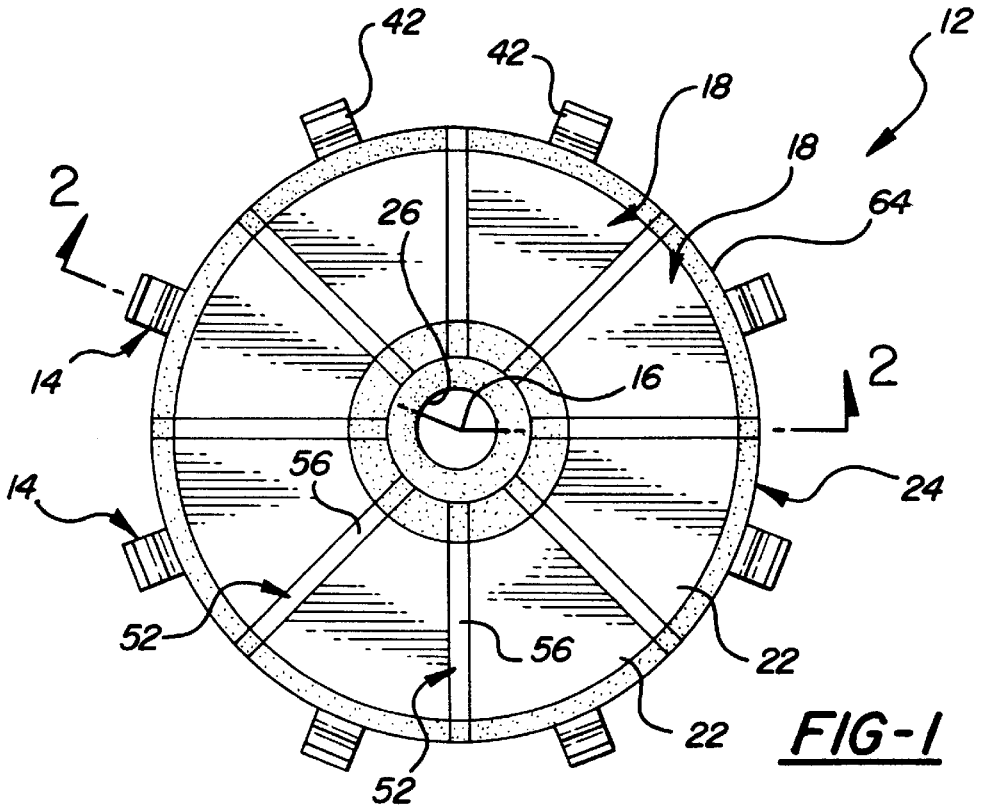
FIG. 1 is a top view of a carbon face-type commutator assembly constructed according to the present invention.

A planar face-type carbon-segment commutator assembly for an electric motor is generally shown at 12 in FIGS. 1–3 and 9. The commutator assembly 12 comprises an annular array of eight circumferentially spaced conductor sections, generally indicated at 14 in FIGS. 1–11. Each conductor section 14 is a thin, flat, roughly triangular piece of copper. The conductor sections 14 are arranged around a commutator rotational axis 16 as shown in FIGS. 1–9. Each conductor section 14 has the same general sectorial configuration as all the other conductor sections 14. In other words, and as best shown in FIG. 4, each conductor section 14 has the shape of a pie piece cut from a circular, radially-cut pie.

As generally indicated in FIGS. 1, 2, 8 and 9, the commutator assembly 12 also comprises an annular array of eight circumferentially spaced carbon segments 18. Each carbon segment 18 has the same general sectorial configuration as all the other carbon segments. The segments 18 are initially formed as a single annular carbon disk as shown at 20 in FIG. 6. The carbon disk 20 is made from an electrical-conducting resin-bonded moldable conductive carbon composition before being cut into eight equal segments 18. The carbon disk 20 or "overmold" is overmolded onto the conductor section 14 array so that when the disk 20 is cut, each carbon segment 18 is left formed onto an upper surface of a corresponding one of the conductor sections 14. The annular array of carbon segments 18 has a segmented, circular upper surface 22 that serves as the segmented commutating surface of the commutator.

Figure 2:
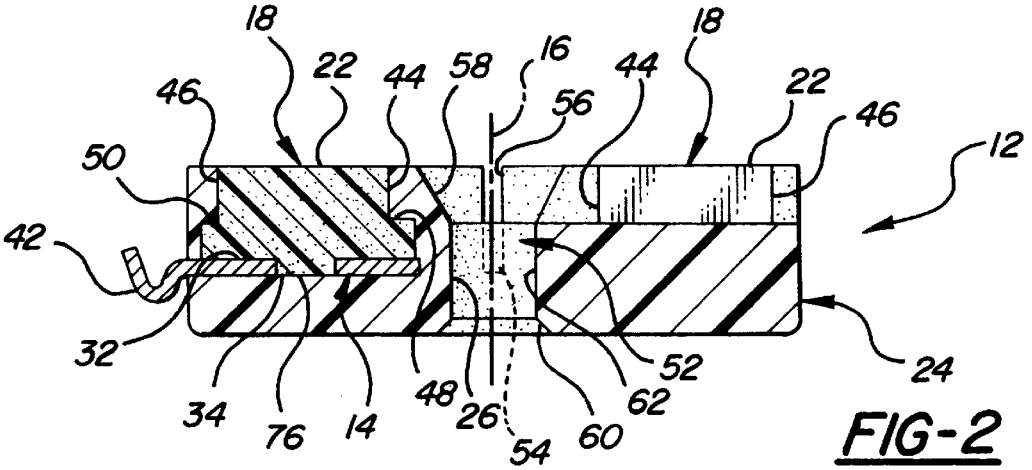
FIG. 2 is a cross-sectional view of the commutator assembly of FIG. 1 taken along line 2—2.
Figure 3:
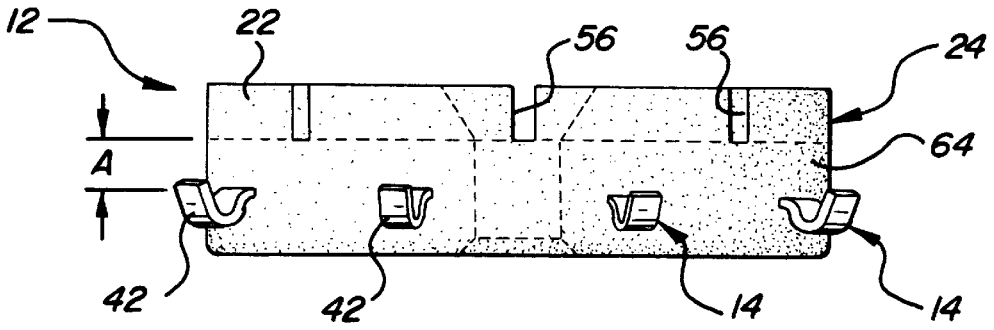
FIG. 3 is a side view of the commutator assembly of FIG. 1.
Figure 4:
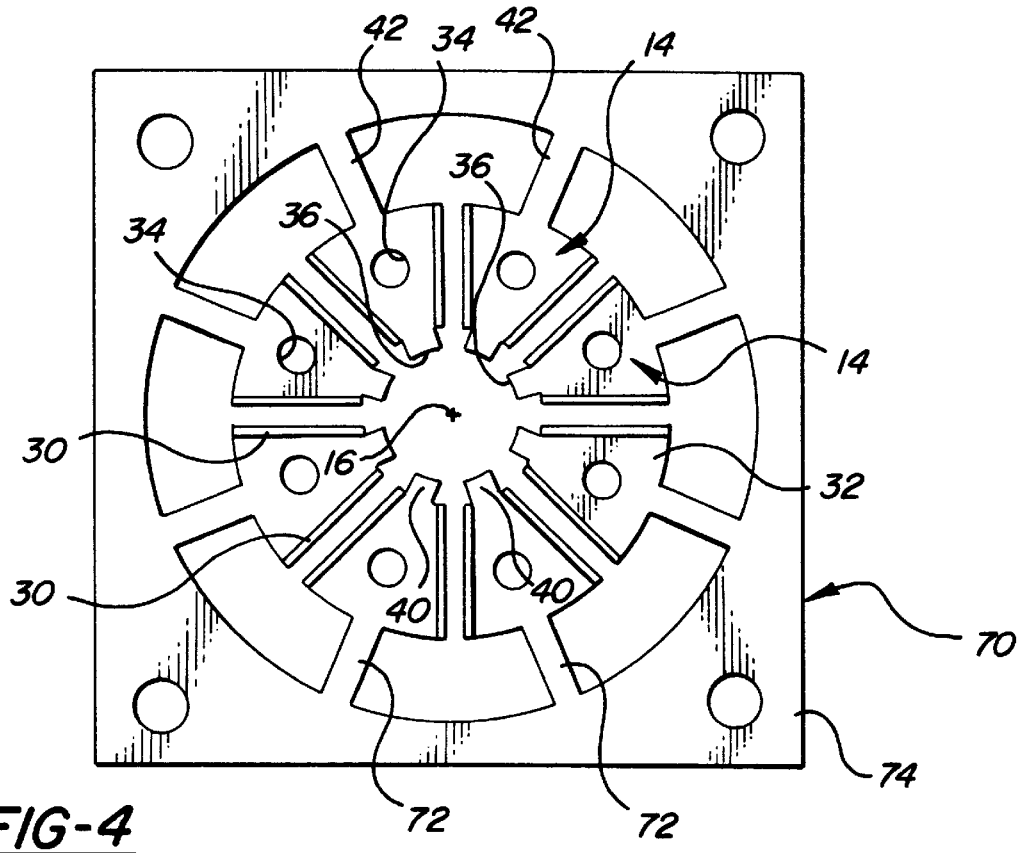
FIG. 4 is a top view of an array of copper conductor sections stamped from a square copper blank in accordance with the present invention.
Figure 9:
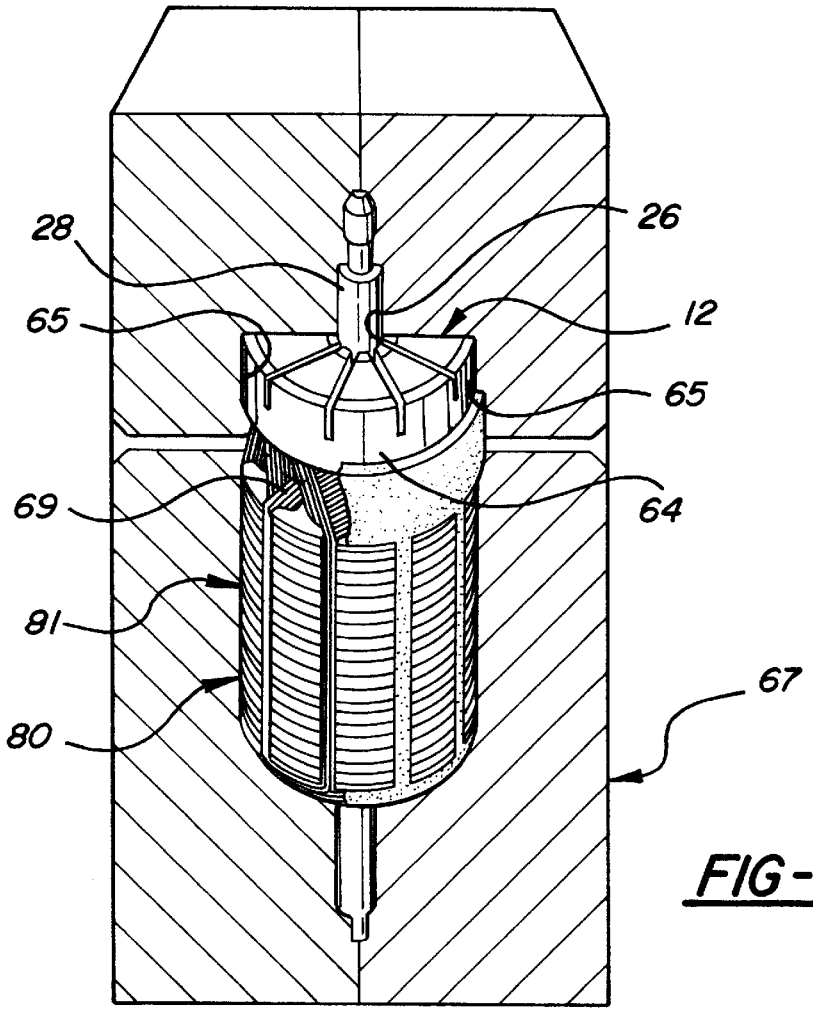
FIG. 9 is a partial cross-sectional, partially cut-away perspective view of a clamshell mold positioned around an armature assembled to a commutator assembly constructed according to the present invention.

An overmolded insulator hub, generally indicated at 24 in FIGS. 1–3, is circumferentially disposed around, under and between the carbon segments 18 and conductor sections 14. When cured, the insulator hub 24 mechanically interlocks the carbon segments 18. The insulator hub 24 has a generally cylindrical shape with a cylindrical armature shaft aperture 26 disposed coaxially along the commutator rotational axis 16. As shown in FIG. 9, the cylindrical armature shaft aperture 26 is shaped to receive an armature shaft 28.

Figure 5:
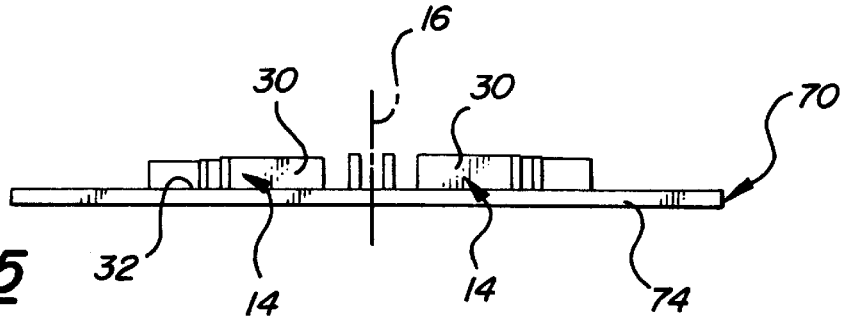
FIG. 5 is a side view of the stamped copper blank of FIG. 4.

Each conductor section 14 has two integral upturned conductor projections, shown at 30 in FIGS. 4 and 5. The conductor projections 30 extend from opposing diagonal edges of an upper surface 32 of the conductor section 14. When the carbon composition is overmolded onto the conductor section 14 array, the upturned projections 30 are embedded in the overmolded mass 20. After the carbon disk 20 is cut into segments 18, each of the upturned projections 30 of each conductor section 14 remains embedded in a corresponding one of the overmolded carbon segments 18. The embedded projections 30, because of their shape and location within the carbon segments 18, reduce electrical resistance by increasing surface area contact between each conductor section 14 and its corresponding carbon segment 13 as will be discussed hereinafter in greater detail.

Each conductor section 14 in the conductor section 14 array includes a circular conductor section aperture, shown at 34 in FIGS. 2 and 4. A conductor section aperture 34 is disposed approximately midway between an inner apex 36 and an outer semi-circumferential margin 38 of each conductor section 14. As shown in FIGS. 4 and 6–8, at the inner apex 36 of each conductor section 14 is a rectangular apex tab 40. As is best shown in FIGS. 1–3, a tang 42 extends integrally and radially outward from the outer semi-circumferential margin 38 of each conductor section 14.

As shown in FIGS. 4 and 5, the conductor projections 30 are bent-up portions that extend integrally upward from the conductor sections 14. Each conductor section 14 includes two such bent-up projections 30. Each bent-up projection 30 is elongated and rectangular in shape and is bent-up (i.e., bent axially outward) from its respective conductor section 14 along a lower elongated margin.

Each conductor section 14 is embedded between the insulator hub 24 and one of the overmolded carbon segments 18. The tang 42 of each conductor section 14 protrudes radially outward from the insulator hub 24.

Figure 8:
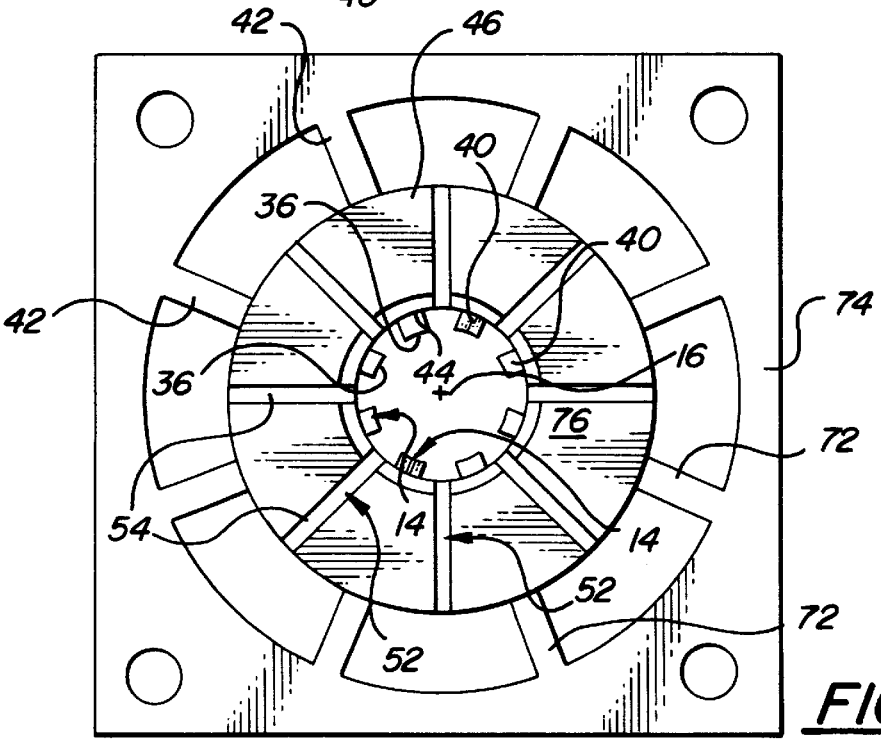
FIG. 8 is a bottom view of the overmolded stamped blank of FIG. 6.

As is best shown in FIGS. 1 and 8, each carbon segment 18 has the general shape of a piece of a radially-cut circular pie, i.e., the same general shape as each conductor section 14. However, each carbon segment 18 is longer, wider and thicker than each conductor section 14. Each carbon segment 18 has an inner apex wall 44 and an outer semi-circumferential peripheral wall 46. Both the inner apex wall 44 and the outer circumferential wall 46 of each carbon segment 18 have stair-stepped profiles which define an inner shelf-detent 48 and an outer shelf-detent 50, respectively.

The carbon segments 18 are made of an injection-molded and hardened composition of graphite powder and carrier material with the graphite powder making up 50–80% of the total composition weight. The carrier material is preferably a polyphenylene sulphide (PPS) resin. While this composition is suitable for practicing the invention, other carbon compositions known in the prior art are suitable for use in the present invention depending upon the application in which the armature is used.

In other embodiments, metal particles may be embedded in the composition of carbon powder and carrier material to reduce electrical resistance between each conductor section and its corresponding carbon segment by improving carbon segment surface conductivity. The total metal content of the composition in such embodiments would be less than 25%. The metal particles could have one or more of a number of different configurations to include powder flakes. The metal particles would preferably be made of silver or copper.

Radial interstices, generally indicated at 52 in FIGS. 1, 2, 3, 7 and 8. separate the carbon segments 18. Each of the interstices 52 has an inner groove portion 54 and an outer slot portion 56. The inner groove portions 54 are formed during carbon overmolding. The outer slot portions 56 are formed by machining the commutating surface 22.

The insulator hub 24 has flat upper and lower surfaces disposed adjacent the upper and lower edges of the circumferential sidewall. The circumferential hub sidewall is disposed perpendicular to the upper and lower surfaces of the hub 24. As best shown in FIG. 2, the armature shaft aperture 26 includes upper 58 and lower 60 frusto-conical sections that taper inward from larger upper and lower outer diameters to a smaller inner diameter. An inner portion 62 of the armature shaft aperture 26 has a constant diameter, i.e., the smaller inner diameter, along its axial length.

Figure 2A:
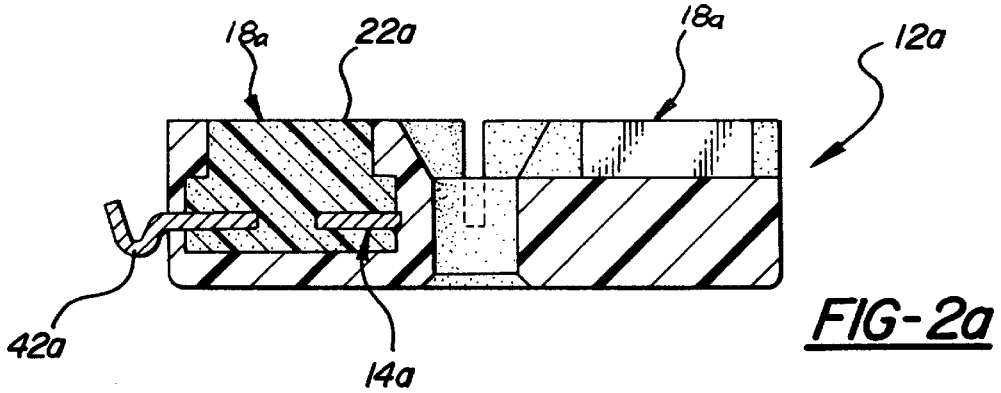
FIG. 2A is a cross-sectional view of an alternative commutator assembly construction to that shown in FIG. 2.

An alternative carbon segment commutator assembly construction is generally indicated at 12*a* in FIG. 2A. Reference numerals with the suffix "a" in FIG. 2A indicate alternative configurations of elements that also appear in the embodiment of FIG. 2. Where a portion of this description uses a reference numeral to refer to FIG. 2, I intend that portion of the description to apply equally to elements designated by numerals having the suffix "a" in FIG. 2A. As shown in FIG. 2A, each carbon segment 18*a* encases one of the conductor sections 14*a*. This arrangement maximizes both strength and electrical contact area between each carbon segment 18*a* and its corresponding conductor section 14*a*.

The inner groove portions 54 of the interstices 52 are filled with the insulator material of the hub 24. Hub insulator material is also disposed around the circumference of the carbon segment 18 array and encases the outer shelf-detent 50 of each carbon segment 18. Hub insulator material that forms the armature shaft aperture 26 also encases the inner shelf-detent 48 of each carbon segment 18.

As is best shown in FIG. 3, the insulator hub 24 includes a circumferential land 64 that extends completely around a circumferential sidewall of the insulator hub 24. The land 64 has an axial width that extends from the protruding conductor section tangs 42 to the unfilled outer slots 56 of the interstices 52. As shown in FIG. 9, the circumferential land 64 provides a circumferential sealing surface to mate with a corresponding surface 65 of a clamshell-type mold 67. The clamshell-type mold 67 is used in a final insulation overmolding process that is explained in greater detail below.

The hub insulator material comprises a glass-filled phenolic available from Rogers Corporation of Manchester Connecticut under the trade designation "Rogers 660." Other materials that would be suitable for use in place of Rogers 660 include high-quality engineering thermoplastics, i.e., thermoplastics that exhibit a high degree of stability when subjected to temperature changes.

In other embodiments, the annular arrays of conductor sections 14 and carbon segments 18 may include either more or less than eight sections, respectively. Also, the carrier material of the carbon composition may comprise a phenolic resin with up to 80% carbon graphite loading, a thermoset resin or a thermoplastic resin other than PPS, such as a liquid-crystal polymer (LCP). Both PPS and phenol type resins withstand long term exposure to fuels and alchohols. Other embodiments may also employ a commutator assembly 12 of the cylindrical or "barrel" type rather than the face-type commutator shown in the figures.

Figure 10:
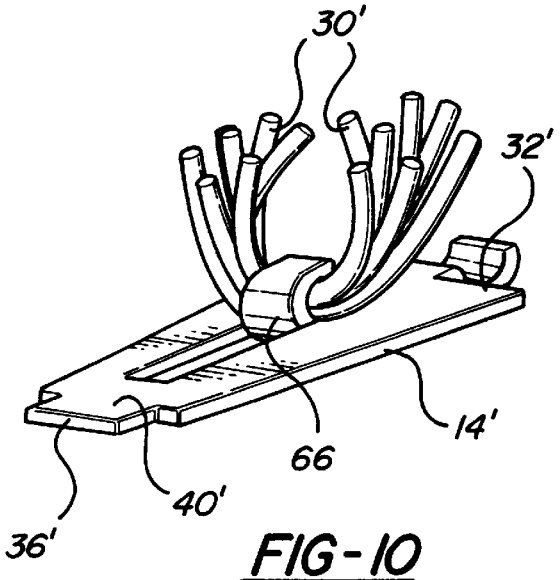
FIG. 10 is a perspective view of an alternative conductor section constructed according to the present invention.

In other embodiments the conductor section projections 30 may have any one or more of a large number of possible configurations designed to increase carbon to copper surface contact. For example, rather than comprising single bent-up portions of the conductor sections as shown at 14 in FIGS. 4 and 5, the projections may instead comprise separate elements, crimped into place under a bent-over finger 66 extending from the conductor sections 14' as shown in FIG. 10. As is also shown in FIG. 10, the separate elements 30' may take the form of a plurality of narrow elongated metallic strands. In FIG. 10, a wire brush-like bundle of metallic strands is shown crimped to a conductor section 14' by bending a metal finger 66 away from the conductor section 14' and crimping the finger 66 over the wires.

Figure 11:
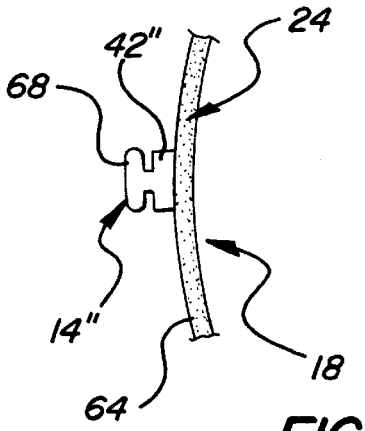
FIG. 11 is a top view of an alternative conductor section tang constructed according to the present invention.

As shown in FIG. 11, other embodiments could include tangs 42" formed with terminations 68 that each include a pair of slots for receiving insulated electrical wires, i.e., "insulation displacement"-type terminations. When an insulated wire is forced laterally into one of these slots, metal edges defining the sides of the slot cut through and force apart the wire insulation to expose and make electrical contact with the wire.

In embodiments using insulation-displacement type tang terminations 68, wires extending from the armature windings 69 could be forced into the respective terminals 42" either during or after armature winding process. This would eliminate the need to weld or heat-stake the wires to the tang terminations 68.

In practice, the carbon commutator described above is constructed by first forming the annular array of conductor sections 14. This is done by stamping the annular array from a single copper blank 70 as shown in FIGS. 4 and 5. The stamping process leaves each conductor section 14 connected by a thin, radially extending metal strip 72 to an unstamped outer periphery 74 of the copper blank 70. The thin copper strips 72 allow the outer periphery 74 to act as a support ring that holds the conductor sections 14 in position, following stamping, for the subsequent steps in the commutator construction process.

Figure 6:
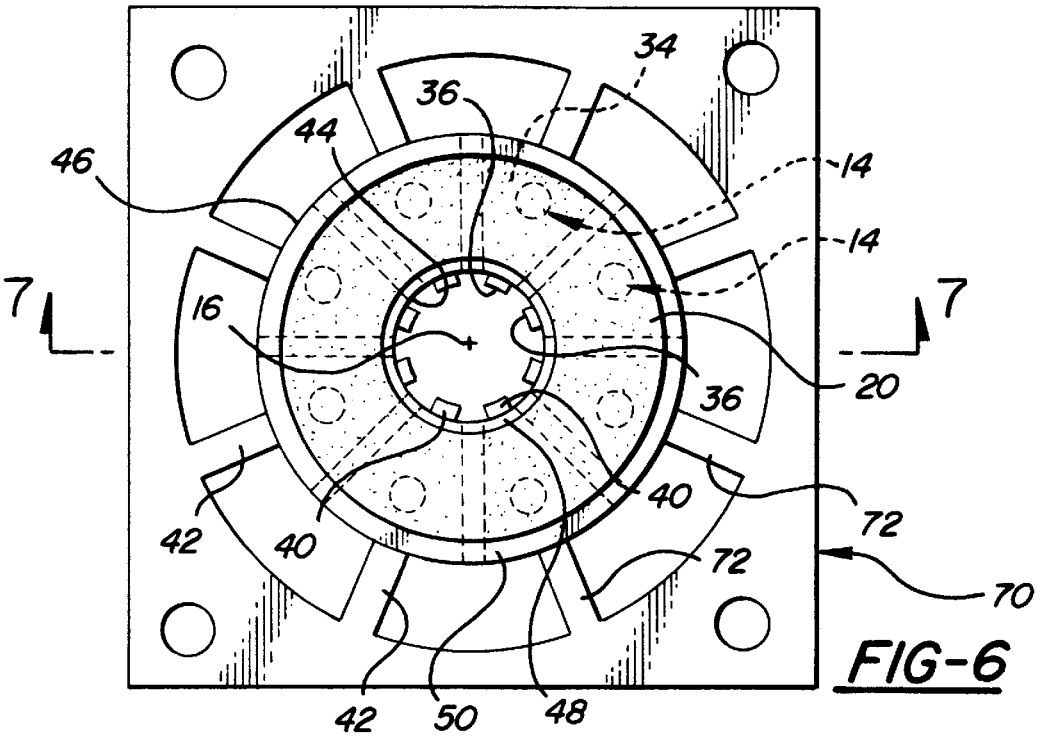
FIG. 6 is a top view of a carbon composition ring overmolded onto the stamped copper blank of FIG. 5 in accordance with the present invention.
Figure 7:
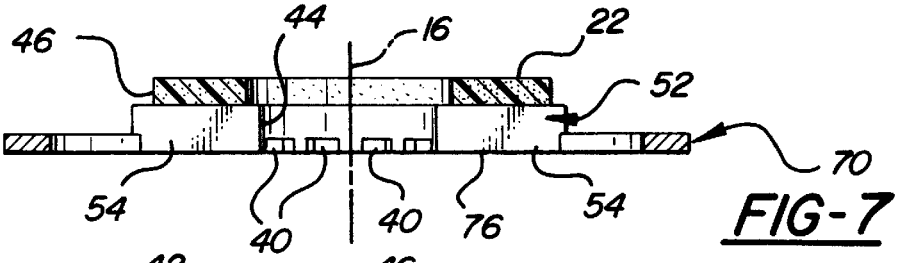
FIG. 7 is a cross-sectional side view of the overmolded stamped blank of FIG. 6 taken along line 7—7 of FIG. 6.

The carbon overmold 20 is then formed, s shown in FIGS. 6 and 8, by molding the carbon composition onto an upper surface 32 of the annular conductor section 14 array. The carbon composition is overmolded in such a fashion as to completely cover and mechanically interlock the conductor sections 14.

In the carbon overmolding process the carbon composition flows into each conductor section aperture 34 and over each peripheral edge of each conductor section. However, as is best shown in FIGS. 4, 6 and 8, the apex tab 40 of each conductor section 14 is left exposed by the carbon overmold 20. The apex tabs 40 extend radially inward into the armature aperture 26.

The carbon composition also envelops the integral upturned conductor projections 30. This allows the projections 30 to extend through the thickness of an insulating surface skin that characteristically forms on exterior surfaces of a carbon overmold 20 as the carbon composition cures. By extending through the insulating skin, the projections 30 serve to reduce the electrical resistance of the contact by increasing the amount of surface area contact between carbon and copper. Also in the carbon overmolding process, the radial groove portions 54 of the interstices 52 are molded into an inside or bottom surface 76 of the carbon overmold 20 opposite the commutating surface 22 and between the conductor sections 14. The grooves 54 may, alternatively, be formed by other well-known means such as machining.

As shown in FIGS. 1–3, the hub 24 is then formed by a second overmolding operation that covers the carbon overmold 20 and conductor section 14 array with the hub insulator material. During this hub overmolding process, the hub insulator material surrounds the carbon overmold 20 and the conductor sections 14. The hub insulator material also completely fills the radial grooves 54 that were formed in the bottom surface 76 of the carbon overmold 20 in the carbon overmolding process, i.e., the inner groove portions 54 of the interstices 52. Only the commutating surface 22 portion of the carbon overmold 20 is left exposed after the hub overmolding operation is complete.

As the insulator hub 24 is being overmolded, insulator material that is formed around the circumference of the carbon segment 18 array also flows over the outer shelf-detent 50 of each carbon segment 18 as is best shown in FIG. 2. Insulator material that is formed around the armature shaft aperture 26 flows over the inner shelf-detent 48 of each carbon segment 18. After the hub insulator material has hardened over the inner 48 and outer 50 shelf-detents of each carbon segment 18 and after the insulator has hardened under the carbon segments 18 and conductor sections 14, the hardened hub insulator material serves to mechanically retain the carbon segments 18 in relation to each other. In addition, the hardened hub insulator material secondarily retains the carbon segments 18 to their respective conductor sections 14.

After the hub 24 has been overmolded onto the carbon overmold 20 and conductor section array, a portion of the outer periphery 74 of the unstamped copper blank 70 is trimmed away from around the overmolded insulator hub 24. Once the periphery 74 has been cut away, each strip 72 is bent to form a short tang 42 of each connecting strip 72 that is left protruding radially outward from an outer circumferential surface of the hub 24. The tangs 42 are thus positioned and configured for use in connecting each conductor section 14 to an armature wire extending from an armature winding.

As is best shown in FIGS. 1–3, the annular array of electrically-isolated carbon segments 18 is then formed by machining the shallow radial slots 56 inward from the exposed commutating surface 22 of the carbon overmold 20 to the underlying radial grooves 54. The slots 56 can be formed by contact or non-contact machining techniques including, but not limited to, those using serrated tooth saws.

Because the radial slots 56 are in direct overlying alignment with the radial grooves 54, the radial slots 56 can be cut completely through the carbon overmold 20 and slightly into the insulator material that occupies the radial grooves 54. This ensures that the carbon overmold 20 is cut completely through and the carbon segments 18 completely separated and electrically isolated from each other. The insulator-filled radial grooves 54 and the radial slots 56 therefore meet within the commutator and form the interstices 52 between the carbon segments 18 as described above.

The insulator-filled radial groove portion 54 of each interstice 52 constitutes approximately half of the depth of each interstice 52. Consequently, to cut the remaining half of the depth of each interstice 52 requires only a relatively shallow slot 56.

Finally, the completed commutator assembly 12 is assembled to an armature assembly 80 as shown in FIG. 9. The clamshell mold 67 is then positioned over the newly assembled commutator-armature assembly, generally indicated at 81 in FIG. 9. While positioning the clamshell mold 67 over the commutator-armature assembly 81, the sealing surface 65 of the clamshell mold 67 is made to seal around the circumferential land 64. Insulator material is then injected into the clamshell mold 67. Once the insulator material has cured, the clamshell mold 67 is removed. This final overmolding step is intended to protect copper armature windings 69 and other corrosion-prone elements from chemically reacting with ambient fluids such as gasoline.

A commutator manufacturing process accomplished according to the present invention involves no copper machining and, therefore, produces no copper shavings and chips that can lodge between carbon segments 18. In addition, no copper is left exposed to react with ambient fluids such as gasoline.

Because a commutator assembly 12 constructed according to the present invention requires only shallow slots 56 in its commutating surface 22 to electrically isolate its carbon segments 18, the completed commutator assembly 12 is stronger and better able to resist breakage. As an alternative to a stronger commutator assembly, the hub 24 of the commutator assembly 12 may be designed to be axially shorter, allowing the commutator-armature assembly to either be designed axially shorter or to carry more armature windings 69. In other words, designers can capitalize on the shorter hub length by either shortening the overall commutator-armature assembly or including more armature windings 69.

One other advantage of the shallow slots 56 is that they allow for the circumferential land 64 between the tangs 42 and the slots 56. By providing a convenient sealing surface for a clam shell mold, the circumferential land 64 eliminates the need for a more complicated operation that involves masking the slots 56 to prevent the outflow of overmolding material into and through the slots 56.

This is an illustrative description of the invention using words of description rather than of limitation. Obviously, many modifications and variations of this invention are possible in light of the above teachings. Within the scope of the claims, one may practice the invention other than as described.

We claim:

1. A carbon-segment commutator assembly for an electric motor, the commutator assembly comprising:

an annular array of at least two circumferentially spaced conductor sections arranged around a rotational axis;

an annular array of at least two circumferentially-spaced overmolded carbon segments formed of a conductive carbon composition, each overmolded carbon segment overmolded onto at least one surface of a corresponding one of the conductor sections, the annular array defining a segmented commutating surface of the commutator;

an overmolded insulator hub disposed around the overmolded carbon segments and between circumferentially adjacent ones of the overmolded carbon segments, the overmolded insulator hub mechanically interlocking the overmolded carbon segments and including an outer surface;

each conductor section having at least one conductor projection at least partially embedded in a corresponding one of the overmolded carbon segments to reduce electrical resistance by increasing surface area contact between each conductor section and its corresponding overmolded carbon segment.

2. A commutator assembly as defined in claim 1 in which the conductor projection comprises a plurality of narrow elongated metallic strands.

3. A commutator assembly as defined in claim 1 in which the conductor sections are made of copper.

4. A commutator assembly as defined in claim 1 in which the commutator assembly is a planar face-type commutator assembly.

5. A commutator assembly as defined in claim 4 in which each conductor section includes an outwardly extending tang portion and in which each conductor section is embedded between the overmolded insulator hub and the overmolded carbon segment with the tang portion of each conductor section protruding outward from the overmolded insulator hub outer surface.

6. A commutator assembly as defined in claim 5 further including at least one radial interstice separating the overmolded carbon segments, the or each interstice having an axially inner groove portion filled with insulator material forming the overmolded insulator hub and an unfilled axially outer slot portion, a circumferential land disposed between the tangs and the unfilled outer slot portion of the interstices, the circumferential land including an unbroken circumferential sealing surface having an axial width that extends from the protruding tang portions to the unfilled outer slots of the interstices.

7. A commutator assembly as defined in claim 1 in which the carbon segments comprise a composition of carbon powder and carrier material.

8. A commutator assembly as defined in claim 7 in which the carbon segments comprise metal particles embedded in the composition of carbon powder and carrier material.

9. A commutator assembly as defined in claim 7 in which the carrier material is selected from a group consisting of phenolic resin, a thermoset resin and a thermoplastic resin.

10. A commutator assembly as defined in claim 7 in which 50–80% of the weight of the carbon composition is made up of graphite.

11. A carbon-segment commutator assembly for an electric motor, the commutator assembly comprising:

an annular array of at least two circumferentially spaced conductor sections arranged around a rotational axis;

an annular array of at least two circumferentially-spaced overmolded carbon segments formed of a conductive carbon composition, each overmolded carbon segment overmolded onto at least one surface of a corresponding one of the conductor sections, the annular array defining a segmented commutating surface of the commutator;

an overmolded insulator hub disposed around and between the overmolded carbon segments, the overmolded insulator hub mechanically interlocking the overmolded carbon segments and including an outer surface; and metal particles embedded in the carbon composition to reduce electrical resistance between each conductor section and its corresponding overmolded carbon segment by improving carbon segment surface conductivity.

12. A commutator assembly as defined in claim 11 in which the carbon composition comprises carbon powder and carrier material.

13. A commutator assembly as defined in claim 11 in which each conductor section has at least one conductor projection at least partially embedded in a corresponding one of the overmolded carbon segments.

14. A planar face-type carbon-segment commutator assembly for an electric motor, the commutator assembly comprising:

an annular array of at least two circumferentially spaced conductor sections arranged around a rotational axis, each conductor section including a radially-outwardly extending tang portion;

an annular array of at least two circumferentially-spaced overmolded carbon segments formed of a conductive carbon composition, each overmolded carbon segment overmolded onto at least one surface of a corresponding one of the conductor sections, the annular array defining a segmented commutating surface of the commutator;

an overmolded insulator hub disposed around the overmolded carbon segments and between circumferentially adjacent ones of the overmolded carbon segments, the overmolded insulator hub mechanically interlocking the overmolded carbon segments and including a circumferential outer surface, the tang portion of each conductor section protruding radially outward from the circumferential outer surface;

at least one radial interstice separating the overmolded carbon segments, the or each interstice having an axially inner groove portion filled with insulator material forming the overmolded insulator hub and a unfilled axially outer slot portion; and a circumferential land disposed between the tangs and the unfilled outer slot portion of the interstices, the circumferential land including an unbroken circumferential sealing surface having an axial width that extends from the protruding tang portions to the unfilled outer slots of the interstices.

15. A planar face-type carbon-segment commutator assembly as defined in claim 14 in which each conductor section includes at least one conductor projection at least partially embedded in a corresponding one of the overmolded carbon segments.

16. A planar face-type commutator assembly as defined in claim 14 in which the carbon segments comprise a composition of carbon powder and carrier material.

17. A planar face-type commutator assembly as defined in claim 16 in which the carbon segments comprise metal particles embedded in the composition of carbon powder and carrier material.

18. A planar face-type commutator assembly as defined in claim 16 in which the carrier material is selected from a group consisting of phenolic resin, a thermoset resin and a thermoplastic resin.

19. A commutator assembly as defined in claim 16 in which 50–80% of the weight of the carbon composition is made up of graphite.

* * * * *